US010485367B2

(12) United States Patent
Kopolowitz

(10) Patent No.: US 10,485,367 B2
(45) Date of Patent: Nov. 26, 2019

(54) APPARATUS FOR CANDLE NEST HOLDER

(71) Applicant: Chaim Kopolowitz, Beitar Elit (IL)

(72) Inventor: Chaim Kopolowitz, Beitar Elit (IL)

( * ) Notice: Subject to any disclaimer, the term of this patent is extended or adjusted under 35 U.S.C. 154(b) by 0 days.

(21) Appl. No.: 15/963,211

(22) Filed: Apr. 26, 2018

(65) Prior Publication Data

US 2018/0317688 A1 Nov. 8, 2018

Related U.S. Application Data

(60) Provisional application No. 62/500,678, filed on May 3, 2017.

(51) Int. Cl.
*A47G 33/00* (2006.01)
*F21V 37/00* (2006.01)

(52) U.S. Cl.
CPC ..... *A47G 33/00* (2013.01); *F21V 37/0012* (2013.01); *F21V 37/0041* (2013.01)

(58) Field of Classification Search
CPC .. F21V 37/0095; F21V 2121/00; F21V 35/00; F21V 13/12; F21V 37/00; F21V 13/00; F21Y 2105/10
USPC ..... 431/321, 299, 319, 315, 320
See application file for complete search history.

(56) References Cited

U.S. PATENT DOCUMENTS 1,278,388 A * 9/1918 Sadlo ..... F21V 37/00 431/319
1,570,966 A * 1/1926 Kise ..... F23D 91/02 431/233
1,642,153 A * 9/1927 Kemp ..... F23D 14/10 431/180
1,686,965 A * 10/1928 Engels ..... F16K 17/00 431/66
1,690,119 A * 11/1928 Kelley ..... F23C 99/00 431/11
1,719,615 A * 7/1929 Morse ..... F23K 5/20 431/37
1,754,578 A * 4/1930 Sornberger ..... F23D 5/00 431/285
1,762,038 A * 6/1930 Thekan ..... F23Q 9/00 431/280
1,785,900 A * 12/1930 Hamberger ..... F23D 14/10 239/434.5
1,982,359 A * 11/1934 Smith ..... F23D 3/00 431/196
2,171,916 A * 9/1939 De Leon ..... F23C 99/00 431/196

(Continued)

OTHER PUBLICATIONS

Steampunk oil lamp (Jan. 2017) https://www.youtube.com/watch?v=GynFQkJnWpM.*

*Primary Examiner* — Kevin R Kruer

(57) ABSTRACT

A hanukiah that includes a base, eight oil holders and a ninth one that serve as a shamash. Each of the oil holders is shaped as a hollow cup that has a top opening and a narrower hollow leg that includes two opposite horizontal holes. The oil holders are designed to receive oil for lighting a wick. The base includes nine vertical holes which are designed to receive the narrow hollow legs in a way that enables them to rotate inside. The vertical holes are connected together by a horizontal pipe. The user may pour oil into the shamash oil holder and by that to fill the other oil holders. The user may turn one of said oil holders to determine how many of them will be filled by oil.

1 Claim, 8 Drawing Sheets

(56) References Cited

U.S. PATENT DOCUMENTS

| | | | | | |
|---|---|---|---|---|---|
| 4,097,224 | A * | 6/1978 | Cooksley | F22B 1/14 | 122/367.3 |
| 4,276,016 | A * | 6/1981 | Lockwood | F21V 37/00 | 431/323 |
| 4,524,408 | A * | 6/1985 | Minera | F21V 35/00 | 362/163 |
| 4,835,663 | A * | 5/1989 | Abbott | F21S 13/00 | 362/159 |
| 6,227,190 | B1 * | 5/2001 | Glass | F23Q 13/04 | 126/25 B |
| 6,491,516 | B1 * | 12/2002 | Tal | A47G 33/00 | 273/147 |
| 6,746,235 | B1 * | 6/2004 | Aszenbrenner | F23D 3/02 | 431/125 |
| 9,851,095 | B2 * | 12/2017 | Barrett | A47G 33/00 | |
| 2006/0044790 | A1 * | 3/2006 | Crawley | A23G 3/50 | 362/153 |
| 2007/0009846 | A1 * | 1/2007 | Bolanos | F23D 3/24 | 431/320 |
| 2010/0062382 | A1 * | 3/2010 | Carey Stachowski | F23D 3/08 | 431/144 |
| 2010/0104993 | A1 * | 4/2010 | Ryser | F23D 3/16 | 431/252 |
| 2013/0288187 | A1 * | 10/2013 | Imgrundt | F23D 14/26 | 431/258 |
| 2018/0213729 | A1 * | 8/2018 | Lebel | A01G 9/26 | |

* cited by examiner

APPARATUS FOR CANDLE NEST HOLDER

RELATED APPLICATIONS

This application claims benefit of 62/500,678 filed on May 3, 2017.

TECHNICAL FIELD

This invention relates to the way one fills up candle nests on Hanukah holiday each day according to the custom in Judaism. The invention focuses on the action of oil refilling for lighting the threads of the candles nests.

BACKGROUND ART

One of the invention's goals is to quickly fill up the nests with oil by using physical force which enables easy refilling of all the nests in one action. Due to the fact that in Hanukah holiday one must light eight oil nests for each and every day of the eight holiday days, one must fill up each oil candle nest according to the rate day in Hanukah custom.

The conventional nest candle holder is usually simply manufactured, unsteady and uncomfortable to use. One must refill the oil in the nests every day of the holiday; one must do so by filling the nests one by one according to the Hanukah custom in Judaism. The conventional candle nest holder is usually bound to warp and has bad stability connection to the nests with the oil. Many have resorted using a verity of ways to stabilize, improve the candle nest holder. Plus the uncomfortable way of refilling the oil in the nests according to the Hanukah custom, and such ways are not always effective.

DESCRIPTION OF THE DRAWINGS

The intention of the drawings attached to the application is not to limit the scope of the invention and its application. The drawings are intended only to illustrate the invention and they constitute only one of its many possible implementations.

THE INVENTION

Figure 1:
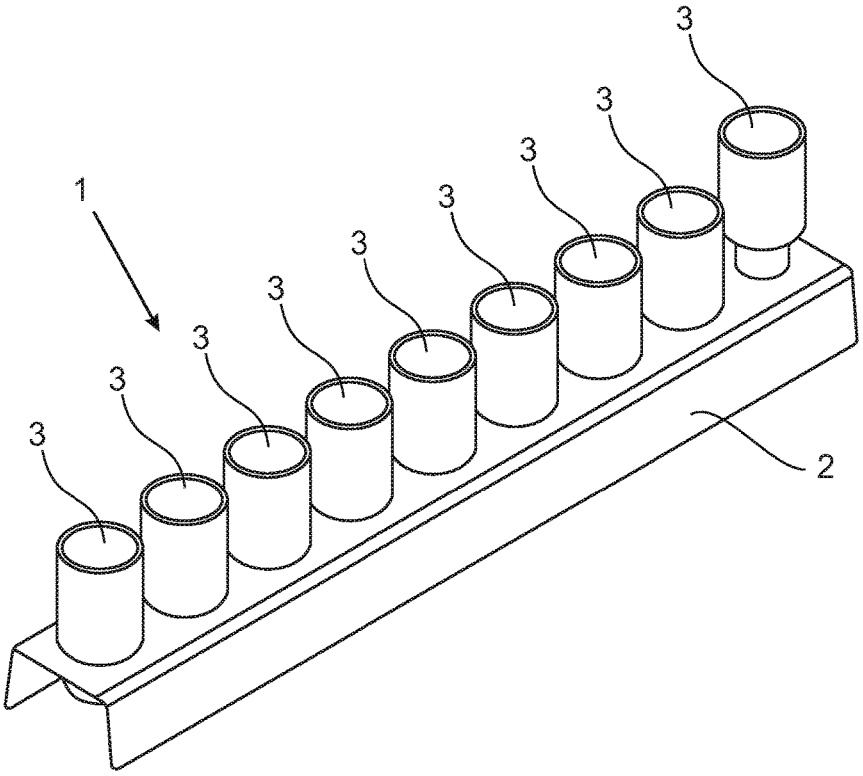
FIGS. 1, 2 and 15 depict the Hanukiah (1).

The object of the present invention is to overcome the above mentioned disadvantages of the prior art by providing a candle nest holder comprising both new designed and stabilized nest connector to the nests holder.

Another feature of the present invention is to provide a safe, clean, comfortable and one time refill of the oil nests according to the Hanukah custom.

A simple, clean, useful and easy design of the problem is long needed, especially in Judaism where millions of candle oil nests are being used in Hanukah every year.

The purpose of the improved candle oil nest holder is to solve three main difficulties: (1) To avoid the need of refilling the candle nests one by one; (2) To stabilize the candle nest holder; and (3) To simplify the use of candle nest holder.

With the use of candle nest holder while filling the nests with oil, the problem is that one needs to carefully fill each and every one of them according to the mitzvah instructions of the Hanukah holiday. This action causes spilling oil, dirt, waist of oil and uncomfortable performance of the mitzvah.

This is an additional invention of an improved candle oil nest holder with the goal of providing easy, clean and efficient refill of the candle nests with oil in Hanukah holiday. This invention enables users to use candle nest holder without the need of filling the nests one by one and without worrying that the candles nest will fall aside.

This comfortable and easy action becomes available by using a strip pipe which connects the nests to a main oil reservoir. Said can be filled and fill up the candle oil nest with one action according to the holiday instructions. This comfortable and easy action becomes available by manufacturing a new set of oil candle nests comprising a pipe shape connector which ships the oil through a hole to the Maine oil reservoir. This invention of a new candle nest shape is connected to the reservoir by an under sleeve perforated with a hole in it similar to the way a tap seals and transports water.

According to the strict instructions of Hanukah holiday in Judaism one must refill some of the nests in relation to the exact day tradition legend of Hanukah. According to the Hanukah mitzvah instructions it is forbidden for a candle to go on lighting by using oil from the other nests reservoir after its own limited oil runs off. Therefore, the under nest perforated sleeve can be turned on its own axis in order prevent oil to continue refilling the nest and to maintain using its own oil supply solely.

This invention efficiently solves unnecessary leakage of oil by securing the connectors between the nests and the reservoir pipe with silicone sealers. The silicone sealers allows easy turning of the nests on their own axis in order to prevent oil from engaging on the other nest and sealing any linkage of oil.

It is known that in Judaism and actually in any religion one must improve constantly the ways he execute the strict religious instructions. This is an additional improvement of the way one fills the oil in candle nests and accordingly this action achieves a clean filling and avoids oil waste.

The invention embodiment offers easy clean and maintaining due to the fact that the oil can be emptied from nine holes of the oil reservoir.

This invention aims to be manufactured in low cost pricing and to be distributed as the next Hanukah menorah.

It is another object of this invention to provide a new candle nest comprising an under perforated sleeve positioned underneath the candle nest holder with the ability to stop oil splay from the main oil tank.

It is another object of this invention to improve the basic nest holder by providing a main oil reservoir up-side perforated pipe shape reservoir component embodied along and under the candle nest holder said comprising the ability off nesting the oil cups in a way that the under perforated pipe can engage the main reservoir and the oil can immediately inter the candle nest when parallel positioned to the main oil reservoir or can be turned against the main reservoir path and stop the oil splay to the candle nest according to the holiday instructions.

The figures depict bottom and side cross-section view of the candle nest holder. The candle oil nest pipe is embodied to the candle nest holder and positioned underneath the candle nest holder, and parallel to the nests holes which are positioned from above in order to receive the oil for the candles. The present invention achieves simplicity manufacturing and cheap materials expenses on the product. The figures depict special designed candle oil nests comprising the ability to mammal oil from said candle oil nest pipe through a perforated sleeve positioned as shown. This action of for filing the candle nests with oil coming from underneath perforated candle nests mammal from a center pipe shaped reservoirs enables one to fill up the candle nests with oil in one action from one of the nests and to flow oil to the other nests according to the Hanukah custom, comprising the ability to stop oil flow from getting riffled unnecessary.

As it is understood from the above explanations and the figures the present application refers to Hanukiah, which is a nine-branched candelabrum lit during the eight-day holiday of Hanukkah according the Jewish tradition. On each night of Hanukkah a new branch is lit. The ninth holder, called the shamash, literary translated as "servant", is for a candle used to light all other candles. To be kosher the shamash must be offset on a higher or lower plane than the main eight candles or oil lamps.

Figure 2:
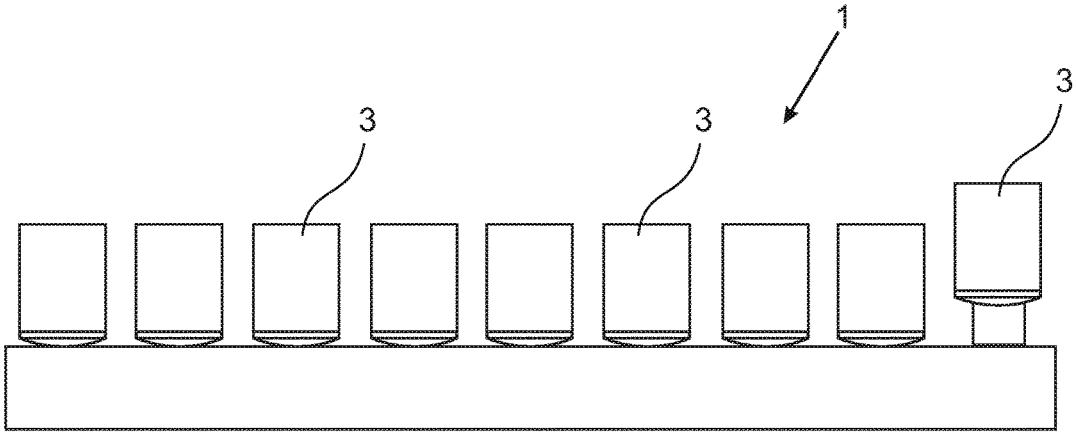

The Hanukiah (1) subject matter of the present invention includes a base (2), eight oil holders (3) and a ninth one that serve as shamash, as depicted for example in FIGS. 1 and 2.

Each oil holder (3) is shaped as a hollow cup that has a top opening (31) a narrower hollow leg (32) that includes two opposite horizontal holes (33), which in fact constitute a horizontal aperture or a horizontal port (33) through the hollow vertical leg (32) for the passage of oil from the hollow vertical leg (32) into the inner horizontal pipe (22), and vice versa. It is possible that two of said oil holders (3) will each includes just one horizontal hole. The oil holders (3) are designed to receive oil for lighting a wick in it. It is possible that the each of said oil holders (3) will includes a rotation limiting element (34). FIGS. 5, 6, 7, 8, 9, 10 and 11 depict the oil holders (3).

Figure 3:
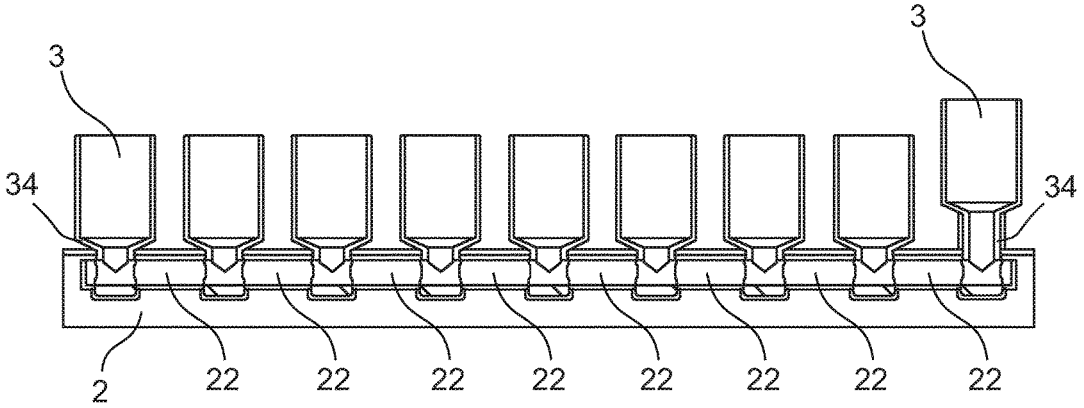
FIGS. 3, 12, 25, 26, 30 and 31 are a cross sectional view of the Hanukiah (1).
Figure 4:
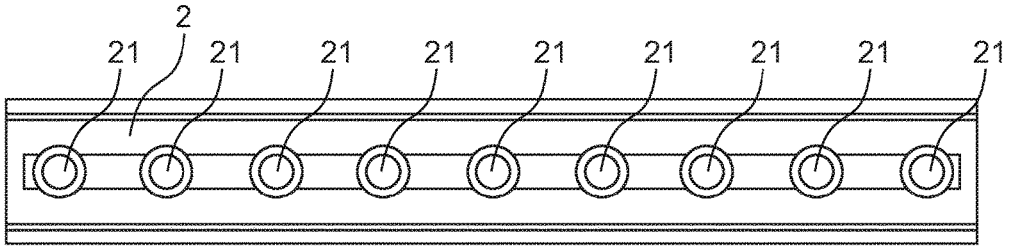
FIG. 4 is a top view of the Hanukiah (1).
Figure 5:
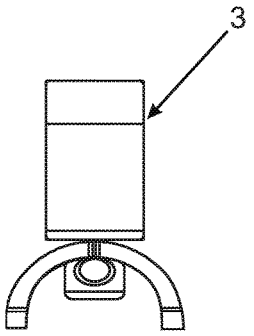
FIGS. 5, 6, 7, 8, 9, 10, 11, 17, 18, 19, 20, 21, 22, 27, 28 and 29 depict the oil holders (3).
Figure 6:
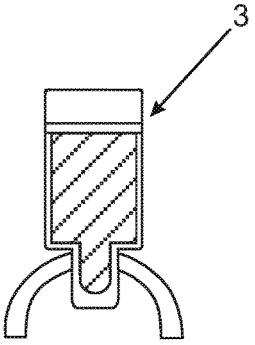
Figure 7:
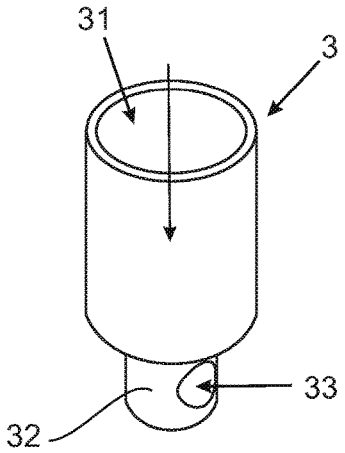
Figure 8:
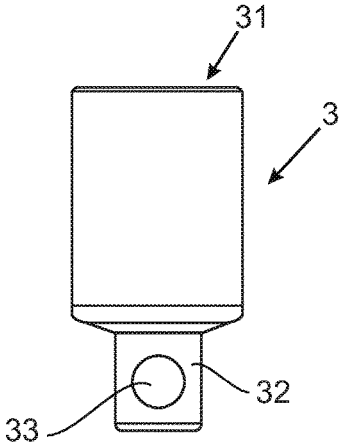
Figure 9:
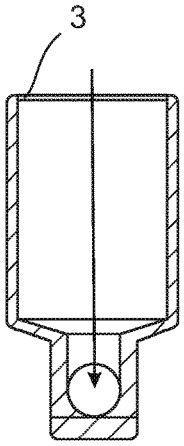
Figure 10:
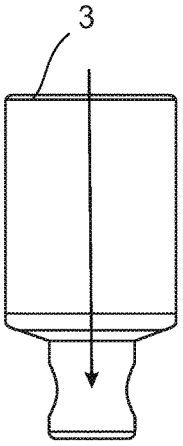
Figure 11:
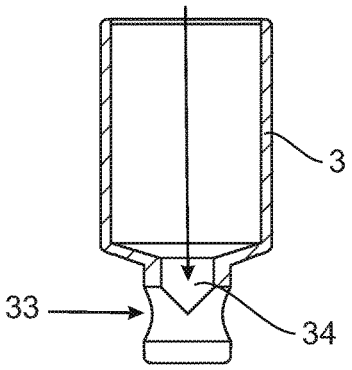
Figure 12:
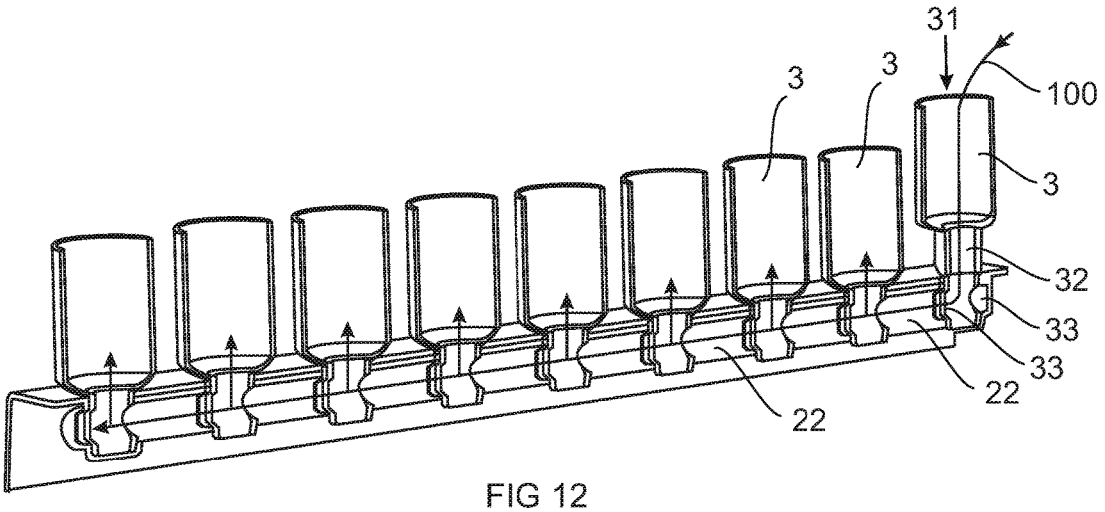
Figure 13:
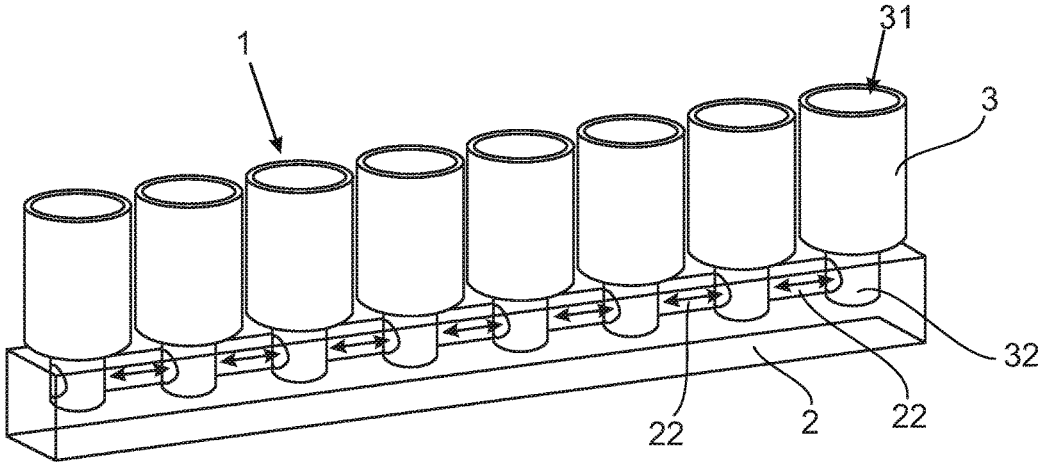
FIGS. 13 and 14 depict the Hanukiah (1) at half transparent style.

The base (2) includes nine vertical holes (21), as depicted for example in FIG. 4, into which the narrow hollow legs (32) are inserted as depicted for example in FIG. 3. The vertical holes (21) are connecting together by a horizontal pipe or a horizontal hole (22), and we will refer to them as "horizontal pipe", which in fact connects every two consecutive vertical holes (21) as depicted for example in FIGS. 3, 12 and 13. FIG. 12 is a cross-sectional view of the Hanukiah (1) and it illustrates the way that a user may stream and fill the oil holders (3) simply by pouring the oil to one of said oil holders, possible to the shamash one. When the user pours oil (100) into the shamash oil holder through its to opening (31) the oil stream out from the its horizontal hole (33) of its narrow hollow leg (32) into the horizontal pipe (22), then come into the narrow hollow leg of the next oil holder through its horizontal hole (33) and then out through its second horizontal hole (33) to the next oil holder and so on. FIG. 13 depicts the same process ad depicted in FIG. 12.

Figure 14:
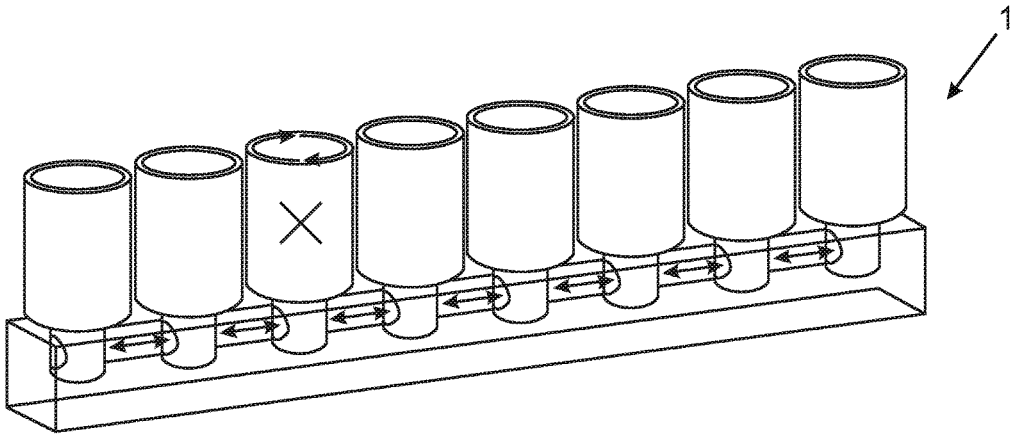

The users light the Hanukiah during 8 days. On the first day of Hanukah holiday the user should light the shamash and one oil holder, on the second day he should light the shamash and two oil holders, and so on until the eighth day on which the user light the shamash and all the other eight oil holders. Therefore, the Hanukiah (1) enables the user to determine how many oil holders will be filled with oil, simply by turning ninety degrees of one of said oil holders. The one that will be rotated 90 degrees will not be filled by oil but only those between it and the shamash. For example, on the fourth day of the holiday in which the user should light four oil holders plus the shamash the user may turn the fifth oil holder as depicted in FIG. 14 and in such case only the oil holder that serves as shamash and the following four oil holders will be filled by oil.

Figure 15:
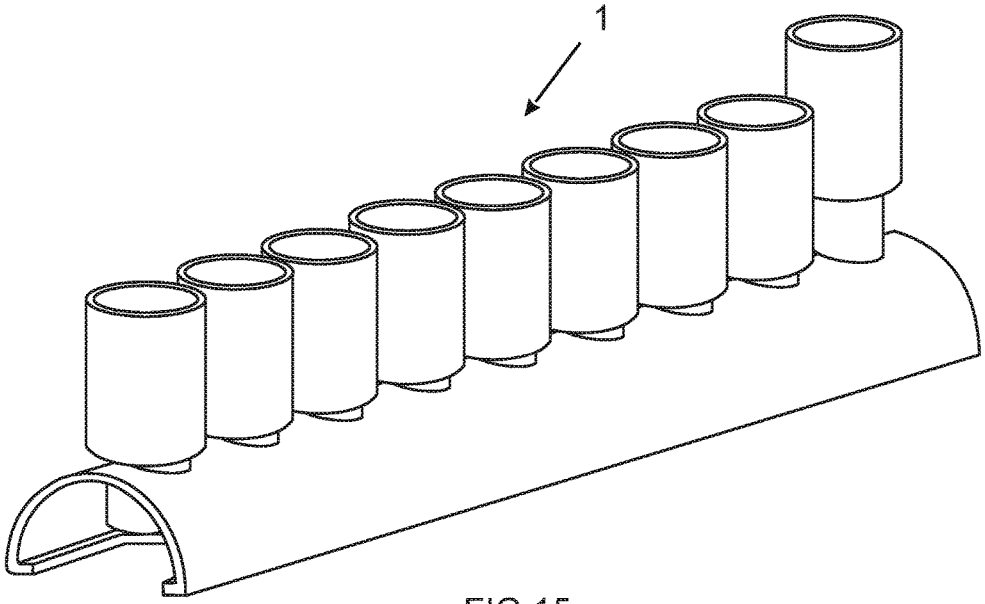
Figure 16:
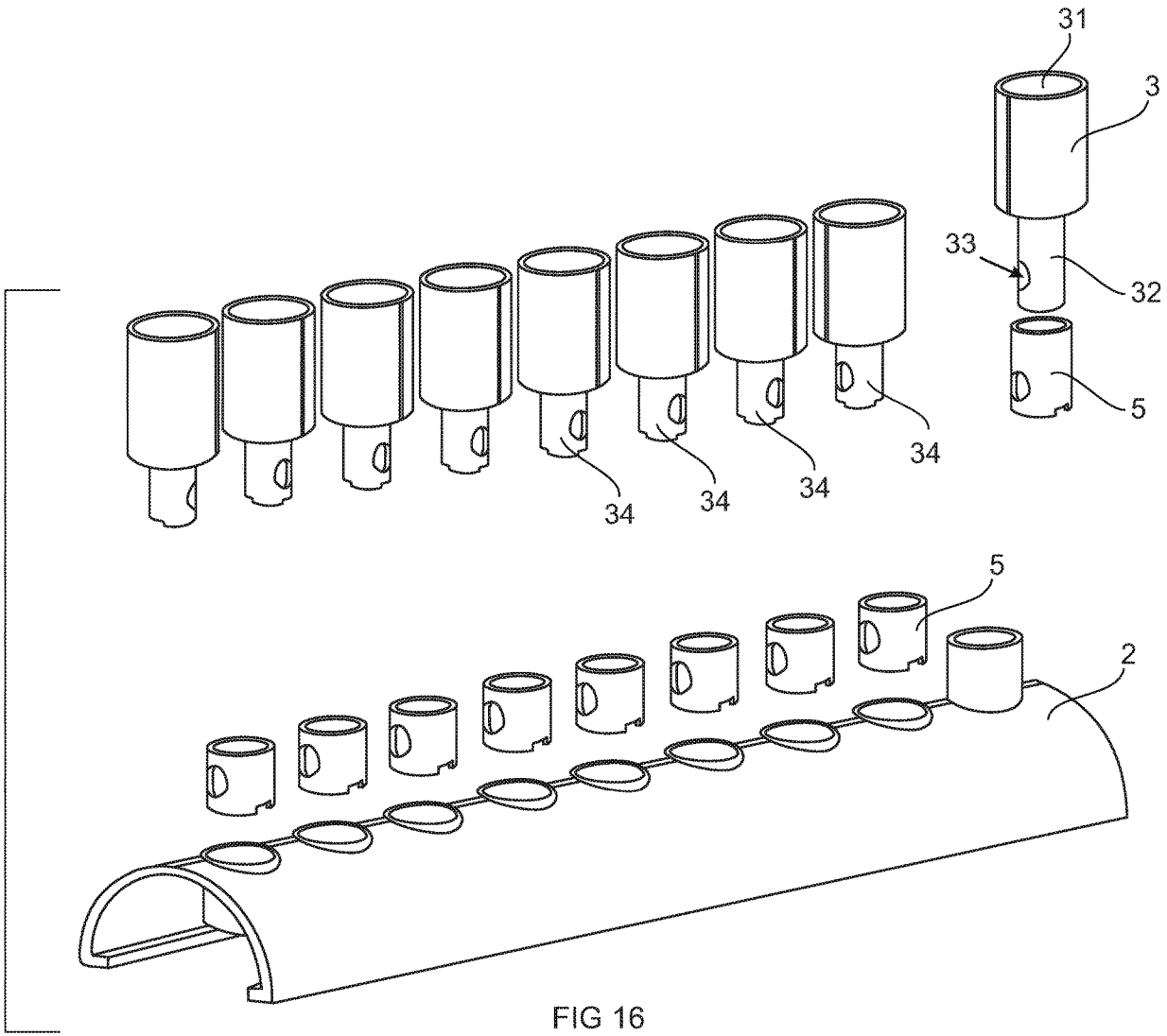
FIG. 16 is an exploded depiction of the Hanukiah (1).
Figure 17:
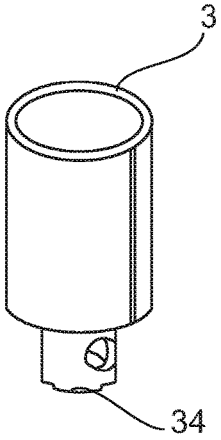
Figure 18:
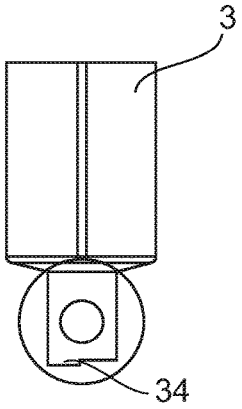
Figure 19:
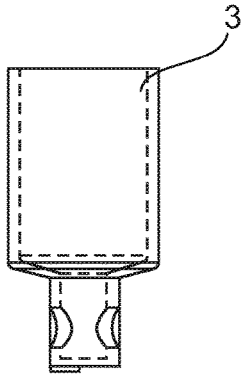
Figure 20:
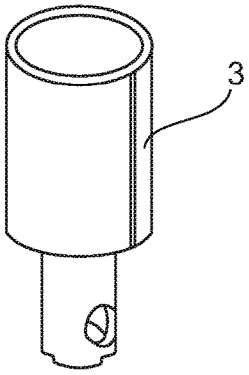
Figure 21:
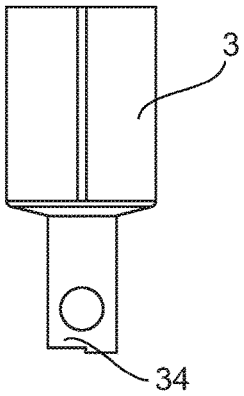
Figure 22:
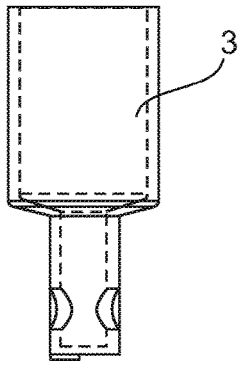

FIG. 15 depicts the general look of the Hanukiah (1) and FIG. 16 is an exploded depiction of it. FIGS. 17, 18 and 19 depict the oil holder (3) that includes a rotation limiting element (34) in the form of a quarter-circle as an extension of their narrow hollow legs. When the narrow hollow leg is inserted inside the vertical hole (21) then the quarter-circle extension is positioned in a half-circle recess (211) and by that it is possible to rotate the oil holder only at 90 degrees. FIGS. 20, 21 and 22 depict the oil holder (3) that serves as shamash, and it is longer than the others.

Figure 23:
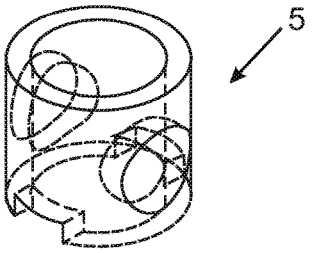
FIGS. 23 and 24 depict the seals (5).
Figure 24:
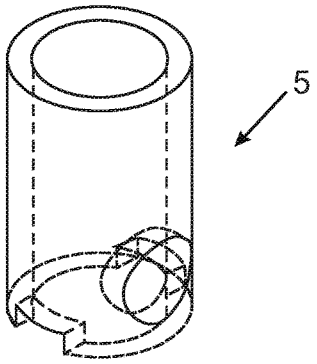
Figure 25:
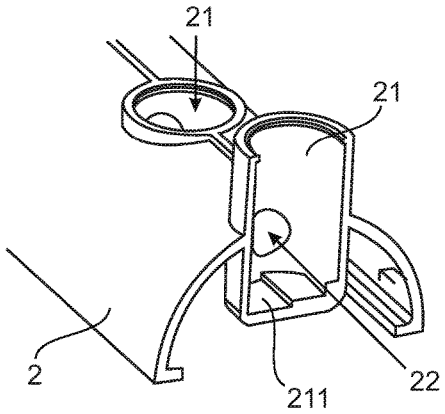
Figure 26:
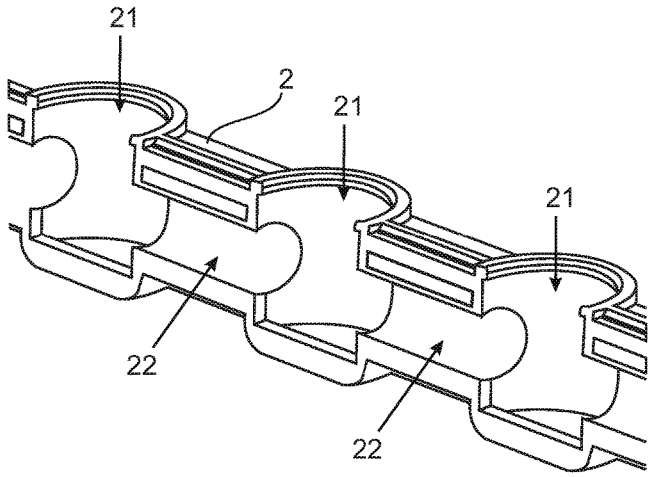
Figure 27:
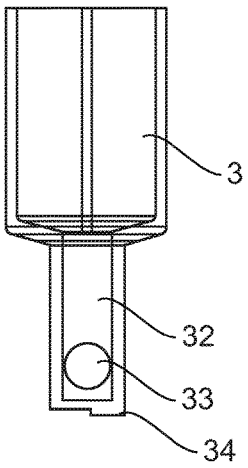
Figure 28:
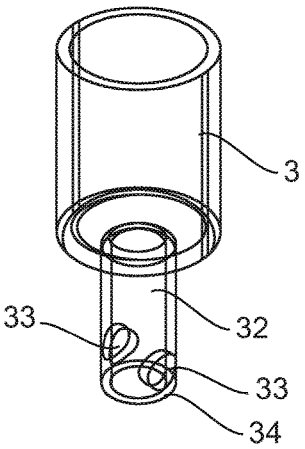
Figure 29:
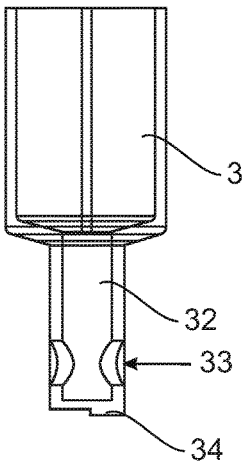
Figure 30:
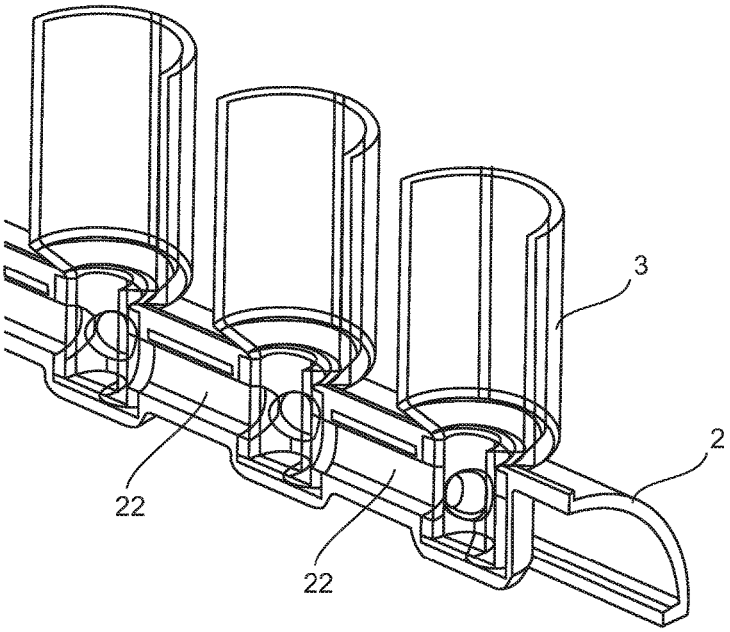
Figure 31:
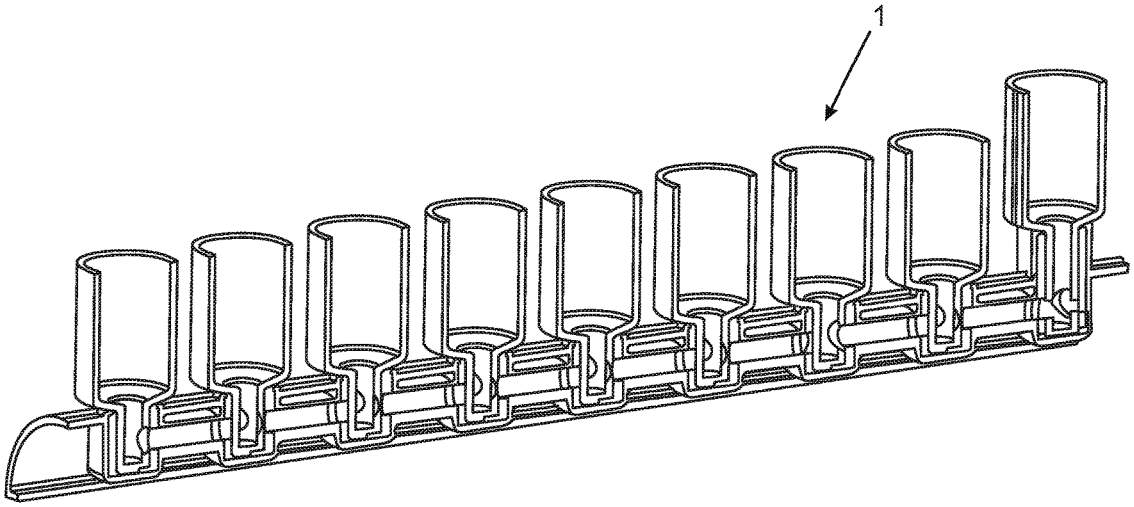

The Hanukiah (1) may include hollow seals (5), as depicted for example in FIGS. 23 and 24, that may be positioned inside the vertical holes (21) and inside them the narrow hollow legs will be inserted and depicted for example in FIG. 16. The hollow seal (5) in FIG. 23 is for the oil holders and the one in FIG. 24 is for the shamash. FIGS. 30 and 31 are cross sectional views of the Hanukiah (1).

From the above explanations and the drawings it is clearly understood that the hanukiah (1), which is the subject matter of the present invention, includes the base (2) and the nine oil holders (3) that are designed to receive oil for lighting a wick. The base (2) includes the horizontal pipe (22) that we can name is as the inner horizontal pipe (22), with the nine vertical holes (21) that we can name them as the nine vertical upper openings (21).

Each of said nine oil holders (3) is shaped as a hollow cup that has the top opening (31) and the hollow vertical leg (32). Each of said hollow vertical legs (32) includes in its bottom part the horizontal port (33). Each of said nine hollow vertical legs (32) is designed to be inserted into the base (2) through each of said nine vertical upper openings (21).

The bottom part of each of said nine hollow vertical legs (32) is designed to be positioned inside the inner horizontal pipe (22) in a way that enable a passage of oil from said hollow vertical leg (32) through said horizontal port (33) into said inner horizontal pipe (22), and vice versa. At least eight of the nine hollow vertical legs (32) are designed to be inserted into the base (2) through eight of the nine vertical upper openings (21) in a way that enables each of said eight oil holders (3) to rotate inside the base from an open position to a closed position.

wherein when one, or more, of said eight oil holders (3) is in the closed position then its bottom part blocks a passage of oil in the horizontal pipe (22) at a point in which said bottom part is located along said horizontal pipe (22), and whereby the hollow vertical legs (32) of said eight oil holders (3) are designed to block or to enable a passage of oil in eight different locations along the inner horizontal pipe (22).

What is claimed is:

1. A Hanukiah comprising:

a base comprised of nine vertical openings on the upper side of said base and an inner horizontal pipe, wherein each of said nine vertical openings connect to said inner horizontal pipe;

and nine oil holders wherein each of said nine oil holders is comprised of a hollow cup which is open at the top and a hollow vertical leg centered at the bottom of said hollow cup wherein said hollow vertical leg is narrower than said hollow cup;

wherein each of said hollow vertical legs includes a horizontal port at the bottom thereof and is inserted into the base through each of said nine vertical upper openings such that said horizontal port of each of said nine hollow vertical legs is positioned inside the inner horizontal pipe of said base;

wherein one of the oil holders is offset on a higher or lower plane than the other eight oil holders;

and wherein at least eight of the nine oil holders are designed to be rotatable inside the base from a position wherein the horizontal port of said oil holder is parallel with the inner horizontal pipe to a position wherein the horizontal port of said oil holder is perpendicular to the inner horizontal pipe.

* * * * *